US005954495A

United States Patent [19]

Knöpfel et al.

[11] Patent Number: 5,954,495

[45] Date of Patent: Sep. 21, 1999

[54] BURNER FOR OPERATING A HEAT GENERATOR

[75] Inventors: Hans Peter Knöpfel, Besenbüren; Thomas Ruck, Mellingen, both of Switzerland

[73] Assignee: ABB Research Ltd., Zurich, Switzerland

[21] Appl. No.: 09/169,140

[22] Filed: Oct. 9, 1998

[30] Foreign Application Priority Data

Oct. 14, 1997 [EP] European Pat. Off. ..... 97810773

[51] Int. Cl.[6] ..... F23Q 9/00

[52] U.S. Cl. ..... 431/285; 431/284

[58] Field of Search ..... 431/285, 284

[56] References Cited

U.S. PATENT DOCUMENTS

| | | | |
|---|---|---|---|
| 5,573,395 | 11/1996 | Althaus et al. | 431/284 |
| 5,584,684 | 12/1996 | Dobbeling et al. | 431/285 |
| 5,876,196 | 3/1999 | Knopfel et al. | 431/284 |

FOREIGN PATENT DOCUMENTS

| | | |
|---|---|---|
| 0376259A2 | 7/1990 | European Pat. Off. . |
| 0670456A1 | 9/1995 | European Pat. Off. . |
| 0780629A2 | 6/1997 | European Pat. Off. . |
| 0780630A2 | 6/1997 | European Pat. Off. . |
| 0797051A2 | 9/1997 | European Pat. Off. . |
| 3033988A1 | 3/1982 | Germany . |
| 06082084 | 3/1994 | Japan . |
| 08082419 | 3/1996 | Japan . |

*Primary Examiner*—Carroll Dority
*Attorney, Agent, or Firm*—Burns, Doane, Swecker & Mathis, L.L.P.

[57] ABSTRACT

In a burner for operating a combustion chamber, which burner essentially comprises a swirl generator (100), a transition piece (200) arranged downstream of the swirl generator, and a mixing tube (20), transition piece (200) and mixing tube (20) forming the mixing section of the burner and being arranged upstream of a combustion space (30), a pilot-burner system (300) is arranged in the lower region of the mixing tube (20), which pilot-burner system (300), at minimized pollutant emissions, stabilizes the flame front, in particular in the transient load ranges.

18 Claims, 6 Drawing Sheets

FIG. 8

BURNER FOR OPERATING A HEAT GENERATOR

BACKGROUND OF THE INVENTION

1. Field of the Invention

The invention relates to a burner for operating a heat generator according to the preamble of claim 1.

2. Discussion of Background

EP-0 780 629 A2 has disclosed a burner which consists of a swirl generator on the incident-flow side, the flow formed herein being passed over smoothly into a mixing section. This is done with the aid of a flow geometry, which is formed at the start of the mixing section for this purpose and consists of transition passages which cover sectors of the end face of the mixing section, in accordance with the number of acting sectional bodies of the swirl generator, and run helically in the direction of flow. On the outflow side of these transition passages, the mixing section has a number of prefilming bores, which ensure that the flow velocity along the tube wall is increased. This is then followed by a combustion chamber, the transition between the mixing section and the combustion chamber being formed by a jump in cross section, in the plane of which a backflow zone or backflow bubble forms.

The swirl intensity in the swirl generator is therefore selected in such a way that the breakdown of the vortex does not take place inside the mixing section but further downstream, as explained above, in the region of the jump in cross section. The length of the mixing section is dimensioned in such a way that an adequate mixing quality is ensured for all types of fuel.

Although this burner, compared with those from the prior art, guarantees a significant improvement with regard to intensification of the flame stability, lower pollutant emissions, lower pulsations, complete burn-out, large operating range, good cross-ignition between the various burners, compact type of construction, improved mixing, etc., it has been found that this burner has no autonomous measures in order to be able to reliably run the gas turbine in particular in its transient load ranges. For example, in the part-load range, the burner must be assisted with a back-up flame. In this case, the integration of such measures in the burner must not lead to any additional pollutant emissions, which could jeopardize the operational and emissive advantages of the burner taken as a basis.

SUMMARY OF THE INVENTION

Accordingly, one object of the invention, as defined in the claims, in a burner of the type mentioned at the beginning, is to propose novel measures which ensure intensification of the flame stability for a stable operation, in particular in the transient load ranges, always with the further proviso that the pollutant emissions remain low.

For this purpose, the burner is extended in such a way that an annular system which is intended for the provision of a fuel/air mixture and generally functions as a pilot stage is provided in the region of its transition to the combustion space arranged downstream. A number of outlet bores which are provided in the peripheral direction and lead into the combustion space create corresponding pilot burners, which for stability reasons are run by diffusion operation and act directly in the combustion space.

The essential advantages of the subject matter of the invention may be seen in the fact that these individual pilot burners are operated with a low proportion of gas, so that the gas introduced there mixes with a relatively small proportion of air and burns as premixed flame with minimized pollutant emissions.

This air quantity, with the aid of impingement cooling, performs the task of cooling the side remote from the combustion chamber before it then mixes with the gas and subsequently, as premixed flame with minimized pollutant emissions, maintains the piloting of the main flame in the combustion space.

Due to this impingement cooling, the surface of the pilot-gas ring is largely isolated from the hot gas and from the flame radiation from the combustion space, so that the thermal loading in this region is substantially reduced.

Even during 100% pilot operation, the individual pilot burners, for stability reasons, burn by diffusion operation, since here the proportion of cooling air compared with the gas is very small.

The subject matter of the invention also achieves the effect that the minimized cooling quantity can likewise be fed to the combustion process.

Advantageous and expedient developments of the achievement of the object according to the invention are defined in the further claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figures 1, 8:
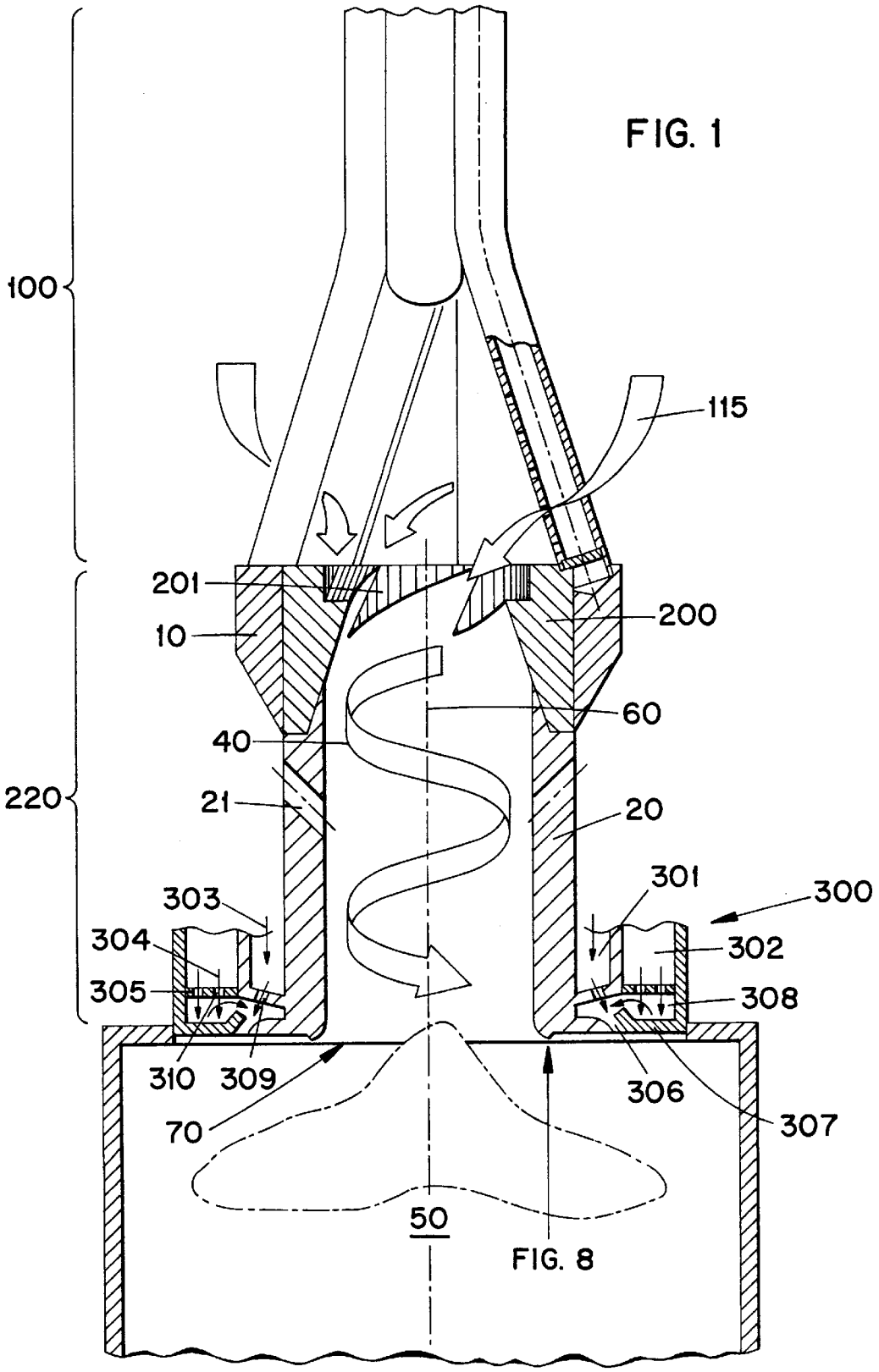
FIG. 1 shows a burner designed as a premix burner and having a mixing section downstream of a swirl generator and pilot burners.
FIG. 8 shows a breakaway edge for the spatial stabilization of the backflow zone.

Referring now to the drawings, wherein like reference numerals designate identical or corresponding parts throughout the several views, all features not essential for the direct understanding of the invention have been omitted, and the direction of flow of the media is indicated by arrows, FIG. 1 shows the overall construction of a burner. Initially a swirl generator 100 is effective, the configuration of which is shown and described in more detail below in FIGS. 3–6. This swirl generator 100 is a conical structure to which a combustion-air flow 115 flowing in tangentially is repeatedly admitted tangentially. The flow forming herein, with the aid of a transition geometry provided downstream of the swirl generator 100, is passed smoothly into a transition piece 200 in such a way that no separation regions can occur there. The configuration of this transition geometry is described in more detail under FIG. 6. This transition piece 200 is extended on the outflow side of the transition geometry by a mixing tube 20, both parts forming the actual mixing section 220. The mixing section 220 may of course be made in one piece; i.e. the transition piece 200 and the mixing tube 20 are then fused to form a single cohesive structure, the characteristics of each part being retained. If transition piece 200 and mixing tube 20 are constructed from two parts, these parts are connected by a sleeve ring 10, the same sleeve ring 10 serving as an anchoring surface for the swirl generator 100 on the head side. In addition, such a sleeve ring 10 has the advantage that various mixing tubes can be used. Located on the outflow side of the mixing tube 20 is the actual combustion space 30 of a combustion chamber, which is symbolized here merely by a flame tube. The mixing section 220 largely fulfills the task of providing a defined section, in which perfect premixing of fuels of various types can be achieved, downstream of the swirl generator 100. Furthermore, this mixing section, that is primarily the mixing tube 20, enables the flow to be directed free of losses so that at first no backflow zone or backflow bubble can form even in interaction with the transition geometry, whereby the mixing quality for all types of fuel can be influenced over the length of the mixing section 220. However, this mixing section 220 has another property, which consists in the fact that, in the mixing section 220 itself, the axial velocity profile has a pronounced maximum on the axis, so that a flashback of the flame from the combustion chamber is not possible. However, it is correct to say that this axial velocity decreases toward the wall in such a configuration. In order also to prevent flashback in this region, the mixing tube 20 is provided in the flow and peripheral directions with a number of regularly or irregularly distributed bores 21 having widely differing cross sections and directions, through which an air quantity flows into the interior of the mixing tube 20 and induces an increase in the rate of flow along the wall for the purposes of a prefilmer. These bores 21 may also be designed in such a way that effusion cooling appears at least in addition at the inner wall of the mixing tube 20. Another possibility of increasing the velocity of the mixture inside the mixing tube 20 is for the cross section of flow of the mixing tube 20 on the outflow side of the transition passages 201, which form the transition geometry already mentioned, to undergo a convergence, as a result of which the entire velocity level inside the mixing tube 20 is raised. In the figure, these bores 21 run at an acute angle relative to the burner axis 60. Furthermore, the outlet of the transition passages 201 corresponds to the narrowest cross section of flow of the mixing tube 20. Said transition passages 201 accordingly bridge the respective difference in cross section without at the same time adversely affecting the flow formed. If the measure selected initiates an intolerable pressure loss when directing the tube flow 40 along the mixing tube 20, this may be remedied by a diffuser (not shown in the figure) being provided at the end of this mixing tube. A combustion chamber 30 (combustion space) then adjoins the end of the mixing tube 20, there being a jump in cross section, formed by a burner front 70, between the two cross sections of flow. Not until here does a central flame front having a backflow zone 50 form, which backflow zone 50 has the properties of a bodiless flame retention baffle relative to the flame front. If a fluidic marginal zone, in which vortex separations arise due to the vacuum prevailing there, forms inside this jump in cross section during operation, this leads to intensified ring stabilization of the backflow zone 50. In addition, it must not be left unmentioned that the generation of a stable backflow zone 50 also requires a sufficiently high swirl coefficient in a tube. If such a high swirl coefficient is undesirable at first, stable backflow zones may be generated by the feed of small, intensely swirled air flows at the tube end, for example through tangential openings. It is assumed here that the air quantity required for this is approximately 5–20% of the total air quantity. As far as the configuration of the burner front 70 at the end of the mixing tube 20 for stabilizing the backflow zone or backflow bubble 50 is concerned, reference is made to the description under FIG. 8. A pilot-burner system 300 is provided concentrically to the mixing tube 20, in the region of its outlet. This pilot-burner system 300 consists of an inner annular chamber 301 into which a fuel, preferably a gaseous fuel 303, flows. Disposed in juxtaposition with this inner annular chamber 301 is a second annular chamber 302 into which an air quantity 304 flows. Both annular chambers 301, 302 have individually configured through-openings in such a way that the individual media 303, 304, with respect to the function, flow into a common annular chamber 308 arranged downstream. The gaseous fuel 303 is passed from the annular chamber 301 into the downstream annular chamber 308 through a number of openings 309 arranged in the peripheral direction. The passage geometry of these openings 309 is configured in such a way that the gaseous fuel 303 flows with a large mixing potential into the annular chamber 308 arranged downstream. The other annular chamber 302 terminates with a perforated plate 305, the bores 310 provided here being configured in such a way that the air quantity 304 flowing through there brings about impingement cooling on the base plate 307 of the annular chamber 308 arranged downstream. This base plate has the function of a heat-shield plate relative to the thermal loading from the combustion space 30, so that this impingement cooling must turn out to be extremely efficient here.

After the cooling has been carried out, this air mixes inside this annular chamber 308 with the gaseous fuel 303 flowing along from the openings 309 of the annular chamber 301 arranged upstream, before this mixture then flows off into the combustion space 30 through a number of bores 306 arranged on the combustion-space side. The mixture flowing out here burns as a premixed diffusion flame with minimized pollutant emissions and therefore forms for each bore 306 a pilot burner which acts in the combustion space 30 and ensures a stable operation.

Figure 2:
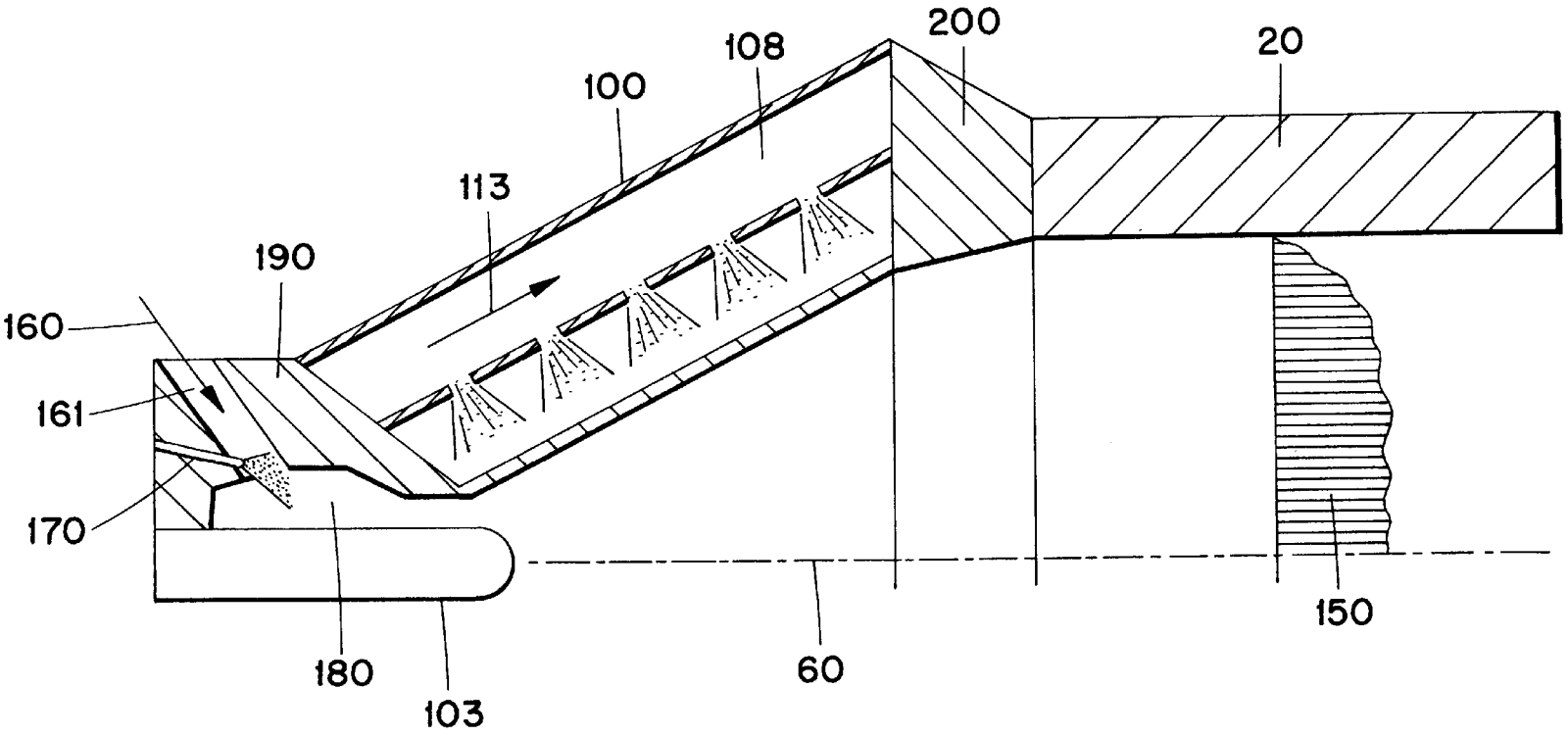
FIG. 2 shows a schematic representation of the burner according to FIG. 1 with the disposition of the additional fuel injectors.

FIG. 2 shows a schematic view of the burner according to FIG. 1, reference being made here in particular to the purging around a centrally arranged fuel nozzle 103 and to the action of fuel injectors 170. The mode of operation of the remaining main components of the burner, namely swirl generator 100 and transition piece 200, are described in more detail under the following figures. The fuel nozzle 103 is encased at a distance by a ring 190 in which a number of bores 161 disposed in peripheral direction are placed, and an air quantity 160 flows through these bores 161 into an annular chamber 180 and performs the purging there around the fuel lance. These bores 161 are positioned so as to slant forward in such a way that an appropriate axial component is obtained on the burner axis 60. Provided in interaction with these bores 161 are additional fuel injectors 170 which feed a certain quantity of preferably a gaseous fuel into the respective air quantity 160 in such a way that an even fuel concentration 150 appears in the mixing tube 20 over the cross section of flow, as the representation in the figure is intended to symbolize. It is precisely this even fuel concentration 150, in particular the pronounced concentration on the burner axis 60, which provides for stabilization of the flame front at the outlet of the burner to occur, whereby the occurrence of combustion-chamber pulsations is avoided.

Figure 3:
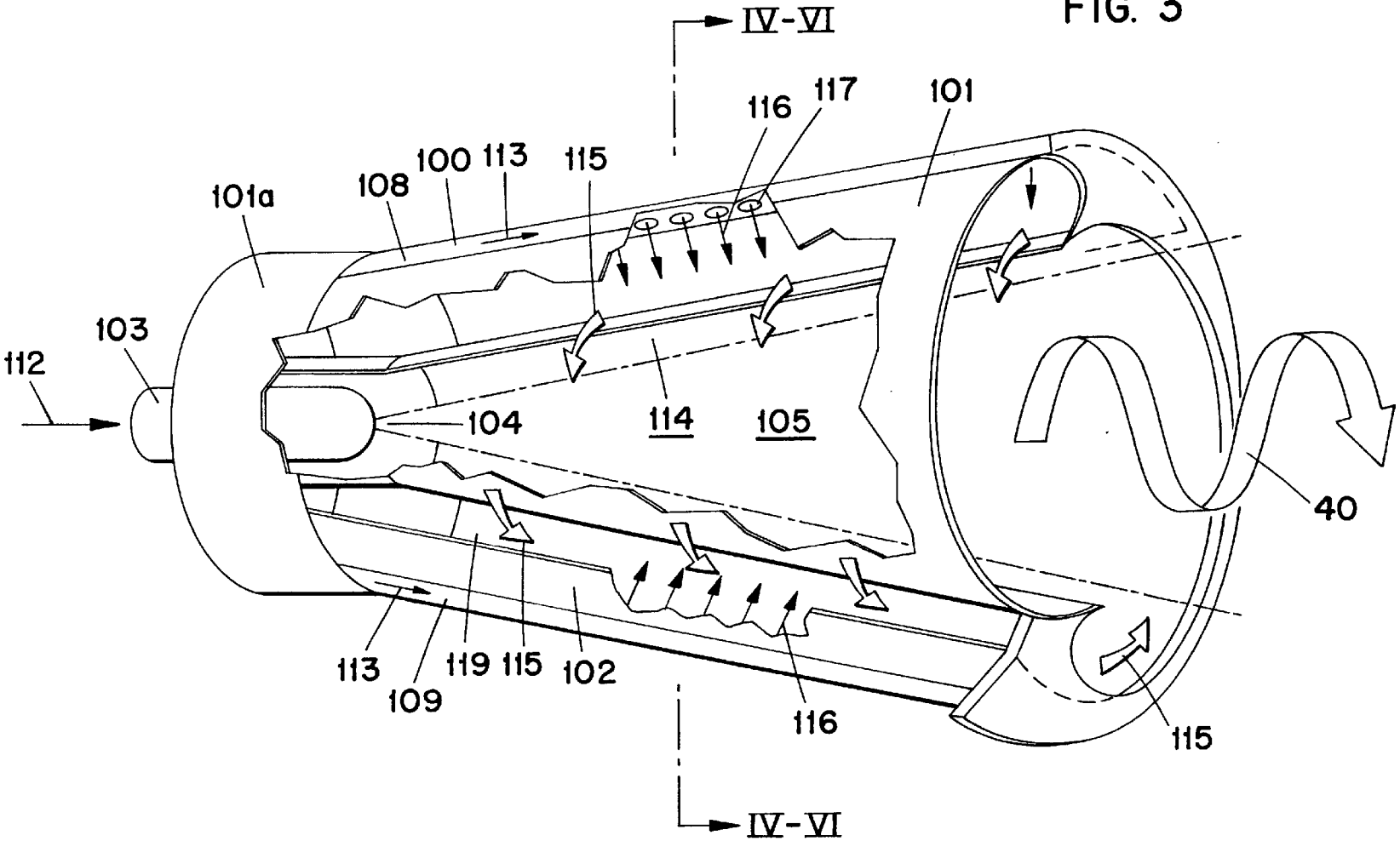
FIG. 3 shows a perspective representation of a swirl generator consisting of a plurality of shells, in appropriate cut-away section.
Figure 4:
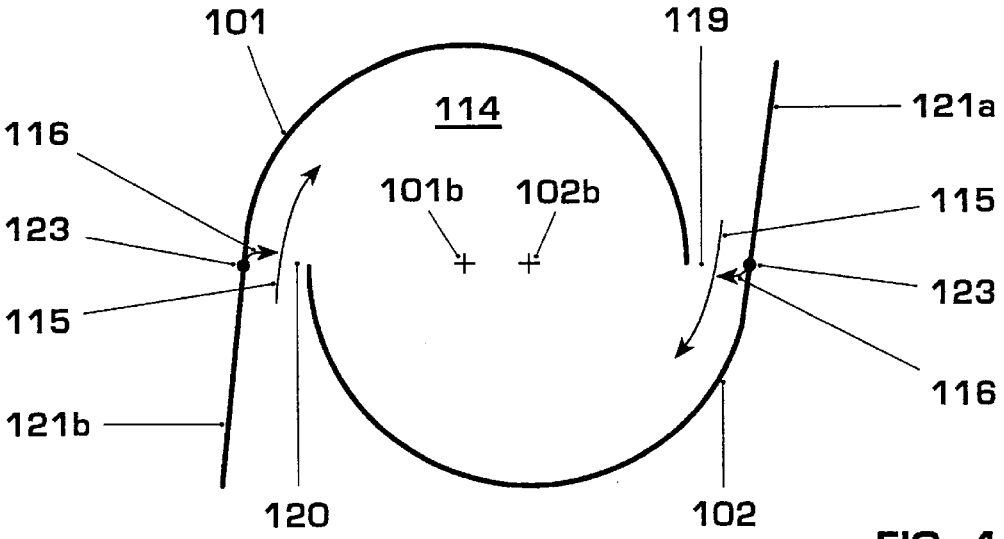
FIG. 4 shows a cross section through a two-shell swirl generator.

In order to better understand the construction of the swirl generator 100, it is of advantage if at least FIG. 4 is used at the same time as FIG. 3. In the description of FIG. 3 below, the remaining figures are referred to when required.

Figure 5:
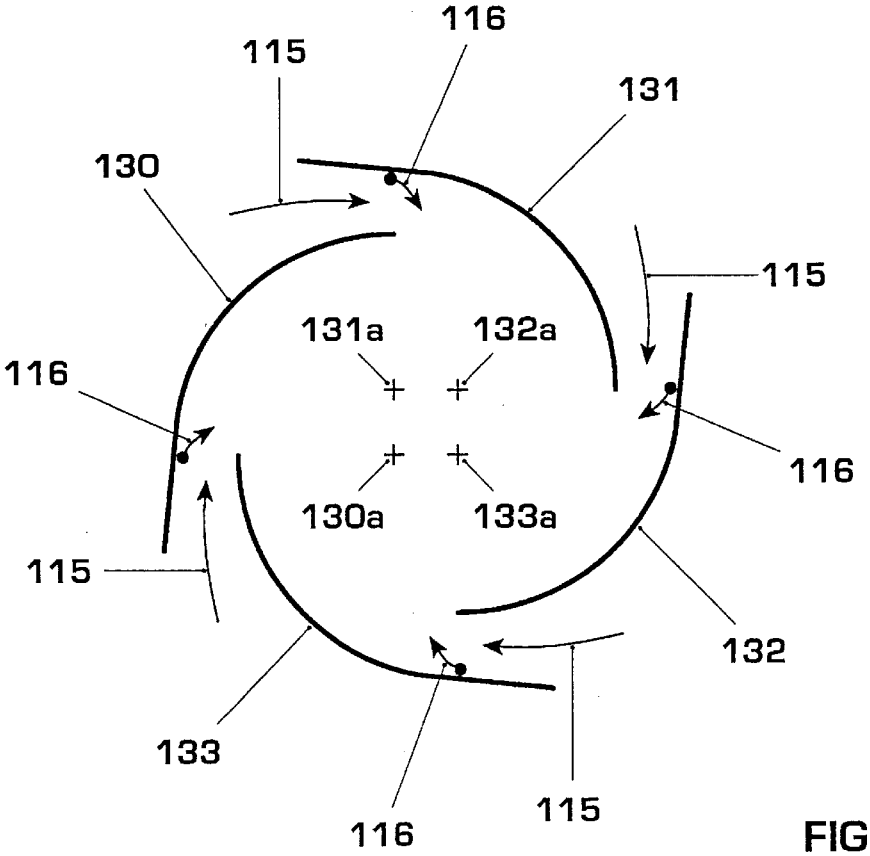
FIG. 5 shows a cross section through a four-shell swirl generator.
Figure 6:
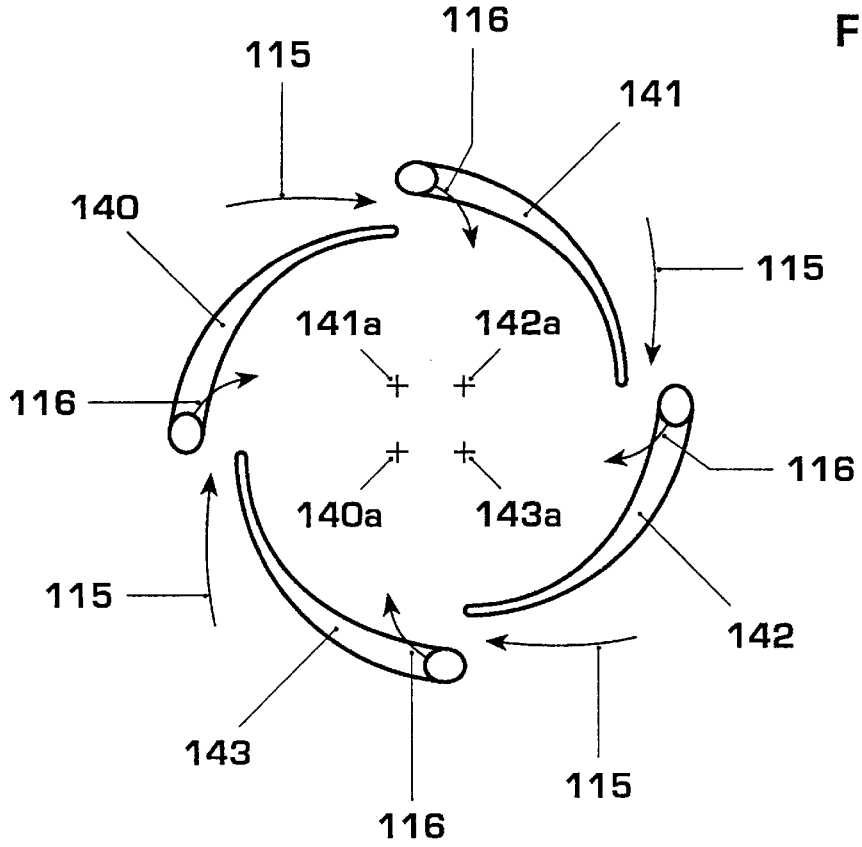
FIG. 6 shows a view through a swirl generator whose shells are profiled in a blade shape.

The first part of the burner according to FIG. 1 forms the swirl generator 100 shown according to FIG. 3. The swirl generator 100 consists of two hollow conical sectional bodies 101, 102 which are nested one inside the other in a mutually offset manner. The number of conical sectional bodies may of course be greater than two, as FIGS. 5 and 6 show; this depends in each case on the mode of operation of the entire burner, as will be explained in more detail further below. It is not out of the question in certain operating configurations to provide a swirl generator consisting of a single spiral. The mutual offset of the respective center axis or longitudinal symmetry axes 101*b*, 102*b* (cf. FIG. 4) of the conical sectional bodies 101, 102 provides at the adjacent wall, in mirror-image arrangement, one tangential duct each, i.e. an air-inlet slot 119, 120 (cf. FIG. 4) through which the combustion air 115 flows into the interior space of the swirl generator 100, i.e. into the conical hollow space 114 of the same. The conical shape of the sectional bodies 101, 102 shown has a certain fixed angle in the direction of flow. Of course, depending on the operational use, the sectional bodies 101, 102 may have increasing or decreasing conicity in the direction of flow, similar to a trumpet or tulip respectively. The two last-mentioned shapes are not shown graphically, since they can readily be visualized by the person skilled in the art. The two conical sectional bodies 101, 102 each have a cylindrical annular initial part 101*a*. Accommodated in the region of this cylindrical initial part is the fuel nozzle 103, which has already been mentioned under FIG. 2 and is preferably operated with a liquid fuel 112. The injection 104 of this fuel 112 coincides approximately with the narrowest cross section of the conical hollow space 114 formed by the conical sectional bodies 101, 102. The injection capacity of this fuel nozzle 103 and its type depend on the predetermined parameters of the respective burner. Furthermore, the conical sectional bodies 101, 102 each have a fuel line 108, 109, and these fuel lines 108, 109 are arranged along the tangential air-inlet slots 119, 120 and are provided with injection openings 117 through which preferably a gaseous fuel 113 is injected into the combustion air 115 flowing through there, as the arrows 116 are intended to symbolize. These fuel lines 108, 109 are preferably arranged at the latest at the end of the tangential inflow, before entering the conical hollow space 114, in order to obtain optimum air/fuel mixing. As mentioned, the fuel 112 fed through the fuel nozzle 103 is a liquid fuel in the normal case, a mixture formation with another medium, for example with a recycled flue gas, being readily possible. This fuel 112 is injected at a preferably very acute angle into the conical hollow space 114. Thus a conical fuel spray 105, which is enclosed and reduced by the rotating combustion air 115 flowing in tangentially, forms from the fuel nozzle 103. The concentration of the injected fuel 112 is then continuously reduced in the axial direction by the inflowing combustion air 115 to form a mixture in the direction of vaporization. If a gaseous fuel 113 is introduced via the opening nozzles 117, the fuel/air mixture is formed directly at the end of the air-inlet slots 119, 120. If the combustion air 115 is additionally preheated or, for example, enriched with recycled flue gas or exhaust gas, this provides lasting assistance for the vaporization of the liquid fuel 112, before this mixture flows into the downstream stage, here into the transition piece 200 (cf. FIGS. 1 and 7). The same considerations also apply if liquid fuels are to be supplied via the lines 108, 109. Narrow limits per se are to be adhered to in the configuration of the conical sectional bodies 101, 102 with regard to the cone angle and the width of the tangential air-inlet slots 119, 120 so that the desired flow field of the combustion air 115 can develop at the outlet of the swirl generator 100. In general it may be said that a reduction in the tangential air-inlet slots 119, 120 promotes the quicker formation of a backflow zone already in the region of the swirl generator. The axial velocity inside the swirl generator 100 can be increased or stabilized by a corresponding feed of an air quantity, this feed being described in more detail under FIG. 2 (item 160). Corresponding swirl generation in interaction with the downstream transition piece 200 (cf. FIGS. 1 and 7) prevents the formation of flow separations inside the mixing tube arranged downstream of the swirl generator 100. Furthermore, the design of the swirl generator 100 is especially suitable for changing the size of the tangential air-inlet slots 119, 120, whereby a relatively large operational range can be covered without changing the overall length of the swirl generator 100. The sectional bodies 101, 102 may of course be displaced relative to one another in another plane, as a result of which even an overlap of the same can be provided. Furthermore, it is possible to nest the sectional bodies 101, 102 spirally one inside the other by a contra-rotating movement. It is thus possible to vary the shape, size and configuration of the tangential air-inlet slots 119, 120 as desired, whereby the swirl generator 100 can be used universally without changing its overall length.

Inter alia, the geometric configuration of baffle plates 121*a*, 121*b*, which may be provided as desired, is now apparent from FIG. 4. They have a flow-initiating function, in which case, in accordance with their length, they extend the respective end of the conical sectional bodies 101, 102 in the incident-flow direction relative to the combustion air 115. The ducting of the combustion air 115 into the conical hollow space 114 can be optimized by opening or closing the baffle plates 121*a*, 121*b* about a pivot 123 placed in the region of the inlet of this duct into the conical hollow space 114, and this is especially necessary if the original gap size of the tangential air-inlet slots 119, 120 is to be changed dynamically, for example in order to change the velocity of the combustion air 115. These dynamic measures may of course also be provided statically by baffle plates forming as and when required a fixed integral part with the conical sectional bodies 101, 102.

FIG. 5, in comparison with FIG. 4, shows that the swirl generator 100 is now composed of four sectional bodies 130, 131, 132, 133. The associated longitudinal symmetry axes for each sectional body are identified by the letter a. It may be said of this configuration that, on account of the smaller swirl intensity thus produced, and in interaction with a correspondingly increased slot width, it is best suited to prevent the breakdown of the vortex flow on the outflow side of the swirl generator in the mixing tube, whereby the mixing tube can best fulfill the role intended for it.

FIG. 6 differs from FIG. 5 inasmuch as the sectional bodies 140, 141, 142, 143 here have a blade-profile shape, which is provided for supplying a certain flow. Otherwise, the mode of operation of the swirl generator is the same. The admixing of the fuel 116 with the combustion-air flow 115 is effected from the interior of the blade profiles, i.e. the fuel line 108 is now integrated in the individual blades. Here, too, the longitudinal symmetry axes for the individual sectional bodies are identified by the letter a.

Figure 7:
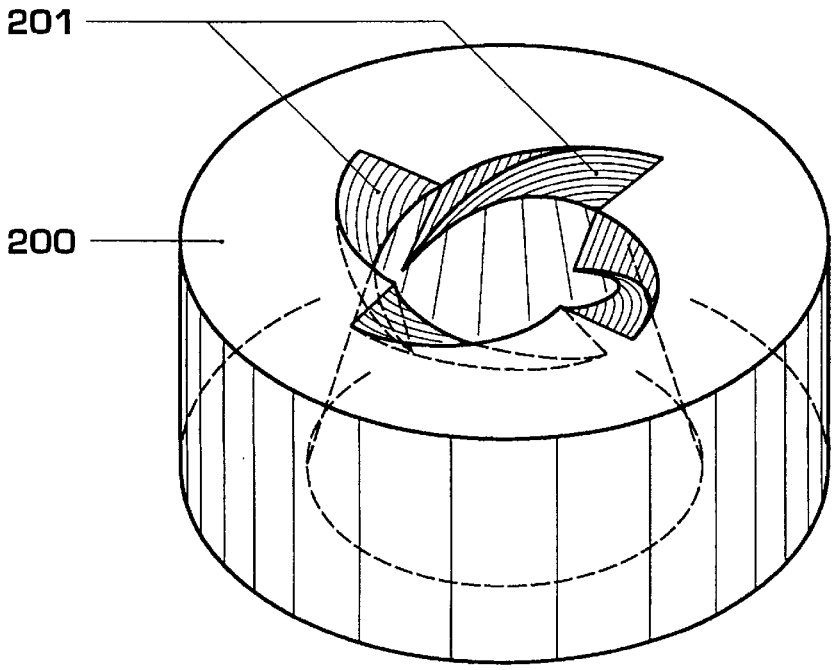
FIG. 7 shows a configuration of the transition geometry between swirl generator and mixing section.
Figure 8:
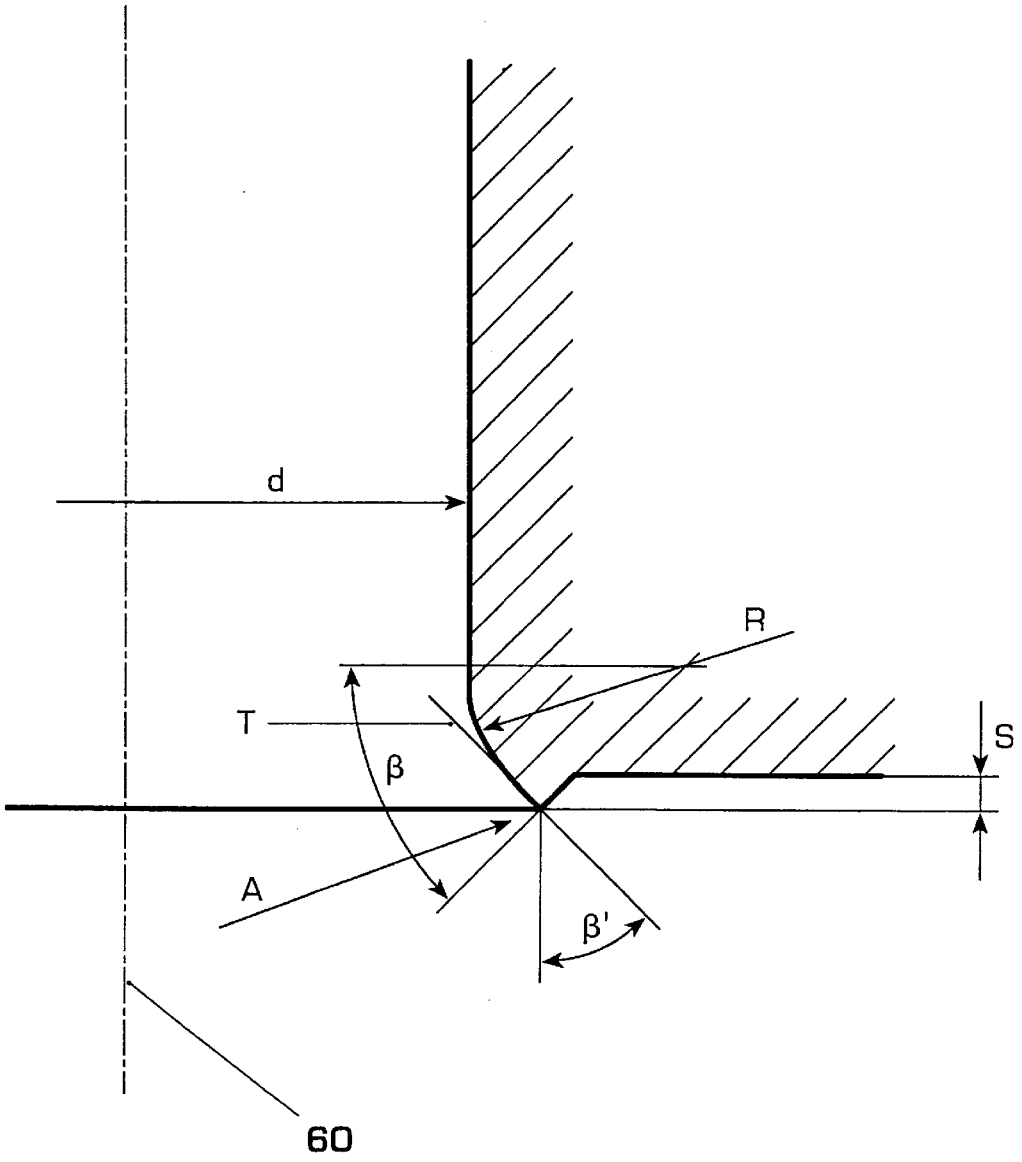

FIG. 7 shows the transition piece 200 in a three-dimensional view. The transition geometry is constructed for a swirl generator 100 having four sectional bodies in accordance with FIG. 5 or 6. Accordingly, the transition geometry has four transition passages 201 as a natural extension of the sectional bodies acting upstream, as a result of which the cone quadrant of said sectional bodies is extended until it intersects the wall of the mixing tube. The same considerations also apply when the swirl generator is constructed from a principle other than that described under FIG. 3. The surface of the individual transition passages 201 which runs downward in the direction of flow has a form which runs spirally in the direction of flow and describes a crescent-shaped path, in accordance with the fact that in the present case the cross section of flow of the transition piece 200 widens conically in the direction of flow. The swirl angle of the transition passages 201 in the direction of flow is selected in such a way that a sufficiently large section subsequently remains for the tube flow up to the jump in cross section at the combustion-chamber inlet in order to effect perfect premixing with the injected fuel. Furthermore, the axial velocity at the mixing-tube wall downstream of the swirl generator is also increased by the abovementioned measures. The transition geometry and the measures in the region of the mixing tube produce a distinct increase in the axial-velocity profile toward the center of the mixing tube, so that the risk of premature ignition is decisively counteracted.

FIG. 8 shows the breakaway edge already discussed, which is formed at the burner outlet. The cross section of flow of the tube 20 in this region is given a transition radius R, the size of which in principle depends on the flow inside the tube 20. This radius R is selected in such a way that the flow comes into contact with the wall and thus causes the swirl coefficient to increase considerably. Quantitatively, the size of the radius R can be defined in such a way that it is >10% of the inside diameter d of the tube 20. Compared with a flow without a radius, the backflow bubble 50 is now hugely enlarged. This radius R runs up to the outlet plane of the tube 20, the angle β between the start and end of the curvature being <90°. The breakaway edge A runs along one leg of the angle β into the interior of the tube 20 and thus forms a breakaway step S relative to the front point of the breakaway edge A, the depth of which is >3 mm. Of course, the edge running parallel here to the outlet plane of the tube 20 can be brought back to the outlet-plane step again by means of a curved path. The angle β' which extends between the tangent of the breakaway edge A and the perpendicular to the outlet plane of the tube 20 is the same size as angle S. The advantages of this design of this breakaway edge can be seen from EP-0 780 629 A2 under the section "SUMMARY OF THE INVENTION". A further configuration of the breakaway edge for the same purpose can be achieved with torus-like notches on the combustion-chamber side. As far as the breakaway edge is concerned, this publication, including the scope of protection there, is an integral part of the present description.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A burner for operating a heat generator, the burner comprising a swirl generator for a combustion-air flow and means for injecting at least one fuel into the combustion-air flow, a mixing section being arranged downstream of the swirl generator and having, inside a first part of the section in the direction of flow, a number of transition passages for passing a flow formed in the swirl generator into a mixing tube arranged downstream of these transition passages, wherein a pilot-burner system (300) is arranged about the lower region of the mixing tube (20) in such a way as to act in a combustion chamber (30) arranged downstream of the mixing tube (20), which pilot-burner system (300) comprises at least two media-carrying chambers (301, 302) and a further common chamber (308) arranged downstream, wherein the media (303, 304) from the other two chambers (301, 302) can be mixed in this chamber (308) arranged downstream, and wherein the chamber (308) arranged downstream has means for forming pilot burners (306) which act in the combustion space (30) and can be operated by the mixture of the two media (303, 304).

2. The burner as claimed in claim 1, wherein the media-carrying chambers (301, 303) are of annular and juxtaposed design, wherein a gaseous fuel (303) flows through the first annular chamber (301) and an air quantity (304) flows through the second annular chamber (302), and wherein fitted in the second annular chamber (302) are means (305) which enable the air (304) flowing there to bring about impingement cooling on a heat-shield plate (307) arranged at the end of the pilot-burner system (300).

3. The burner as claimed in claim 2 wherein the means for forming the impingement cooling is a perforated plate (305) forming a base in the juxtaposed annular chamber (302).

4. The burner as claimed in claim 1, wherein the means for injecting comprise a ring (190) arranged on the head side of the swirl generator (100) and in interaction with a fuel nozzle (103), wherein this ring (190) has a number of bores (161) arranged in the peripheral direction, and wherein a fuel (170) can be injected into an air quantity (160) flowing through the bores (161).

5. The burner as claimed in claim 4, wherein the bores (161) are directed so as to slant forward.

6. The burner as claimed in claim 4, wherein the fuel nozzle (103) is surrounded by an annular air chamber (180).

7. The burner as claimed in claim 1, wherein the burner front of the mixing tube (20) toward the combustion space (30) arranged downstream is formed with a breakaway edge (A).

8. The burner as claimed in claim 1, wherein the number of transition passages (201) in the mixing section (220) corresponds to the number of partial flows formed by the swirl generator (100).

9. The burner as claimed in claim 1, wherein the mixing tube (20) arranged downstream of the transition passages (201) is provided with openings (21) in the direction of flow and in the peripheral direction for injecting an air flow into the interior of the mixing tube (20).

10. The burner as claimed in claim 9, wherein the openings (21) run at an acute angle relative to the burner axis (60) of the mixing tube (20).

11. The burner as claimed in claim 1, wherein the cross section of flow of the mixing tube (20) downstream of the transition passages (201) is less than, equal to or greater than the cross section of the flow (40) formed in the swirl generator **(100, 100*a*)**.

12. The burner as claimed in claim 1, wherein the combustion chamber (30) is arranged downstream of the mixing section (220), wherein there is a jump in cross section between the mixing section (220) and the combustion chamber (30), which jump in cross section induces the initial cross section of flow of the combustion chamber (30), and wherein a backflow zone (50) can take effect in the region of this jump in cross section.

13. The burner as claimed in claim 1, wherein there is a diffuser and/or a Venturi section upstream of the burner front (70).

14. The burner as claimed in claim 1, wherein the swirl generator (100) consists of at least two hollow, conical sectional bodies (101, 102; 130, 131, 132, 133; 140, 141, 142, 143) which are nested one inside the other in the direction of flow, wherein the respective longitudinal symmetry axes (101*b*, 102*b*; 130*a*, 131*a*, 132*a*, 133*a*; 140*a*, 141*a*, 142*a*, 143*a*) of these sectional bodies run mutually offset in such a way that the adjacent walls of the sectional bodies form ducts (119, 120), tangential in their longitudinal extent, for a combustion-air flow (115), and wherein at least one fuel nozzle (103) can take effect in the interior space (114) formed by the sectional bodies.

15. The burner as claimed in claim 14, wherein further fuel nozzles (117) are arranged in the region of the tangential ducts (119, 120) in their longitudinal extent.

16. The burner as claimed in claim 14, wherein the sectional bodies (140, 141, 142, 143) have a blade-shaped profile in cross section.

17. The burner as claimed in claim 14, wherein the sectional bodies have a fixed cone angle, increasing conicity, or decreasing conicity in the direction of flow.

18. The burner as claimed in claim 14, wherein the sectional bodies are nested spirally one inside the other.

* * * * *